US008095059B2

(12) United States Patent
Shintani et al.

(10) Patent No.: US 8,095,059 B2
(45) Date of Patent: Jan. 10, 2012

(54) IMAGE FORMING APPARATUS WITH COATING MODE

(75) Inventors: Takeshi Shintani, Kawasaki (JP); Satoshi Hatori, Yokohama (JP); Yasushi Akiba, Yokohama (JP); Kaoru Yoshino, Tokyo (JP); Akio Kosuge, Yokohama (JP); Takaya Muraishi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 12/416,555

(22) Filed: Apr. 1, 2009

(65) Prior Publication Data

US 2009/0252510 A1 Oct. 8, 2009

(30) Foreign Application Priority Data

Apr. 4, 2008 (JP) ..... 2008-098311

(51) Int. Cl.
*G03G 21/00* (2006.01)

(52) U.S. Cl. ..... 399/346

(58) Field of Classification Search ..... 399/346
See application file for complete search history.

(56) References Cited

U.S. PATENT DOCUMENTS 5,761,594 A * 6/1998 Seto et al. ..... 399/302
7,313,347 B2 12/2007 Shintani et al.
7,333,744 B2 * 2/2008 Shimojo et al. ..... 399/71
2003/0044201 A1 * 3/2003 Kosuge ..... 399/223
2005/0084271 A1 * 4/2005 Koike et al. ..... 399/12
2007/0154246 A1 7/2007 Shintani et al.
2008/0069614 A1 3/2008 Shintani et al.
2008/0069615 A1 * 3/2008 Shintani et al. ..... 399/346

FOREIGN PATENT DOCUMENTS

JP 8-234642 9/1996
JP 2000-330443 11/2000
JP 2002244486 A * 8/2002

OTHER PUBLICATIONS

Machine translation of JP 2002244486.*

* cited by examiner

*Primary Examiner* — David Gray
*Assistant Examiner* — David Bolduc
(74) *Attorney, Agent, or Firm* — Dickstein Shapiro LLP

(57) ABSTRACT

Provided is an image forming apparatus containing: an image-bearing member; a toner removal unit configured to remove a toner remained on the image-bearing member; a coating unit configured to coat a surface of the image-bearing member with a lubricity imparting agent; a unit configured to change a coated state of the lubricity imparting agent which has been applied to the image-bearing member by the coating unit; and a controlling unit configured to control the coating unit so as to operate a coating mode for at least the period when the image-bearing member is rotated once or more in the course of image formation, wherein the coating mode is a mode in which an amount of the lubricity imparting agent applied onto the image-bearing member is increased compared to an applied amount of the lubricity imparting agent during an ordinal operation for image formation.

5 Claims, 6 Drawing Sheets

IMAGE FORMING APPARATUS WITH COATING MODE

BACKGROUND OF THE INVENTION

1. Field of the Invention

The present invention relates to an image forming apparatus such as a photocopier, facsimile, printer, plotter, or a complex device having a plurality of these functions, as well as to a process cartridge for the image forming apparatus.

2. Description of the Related Art

To achieve high image quality using image forming apparatuses such as photocopiers, facsimiles, plotters, or complex apparatuses having these functions, a toner for use therein has been modified and developed in recent years, for example changing the shape of the toner from irregular ones to sphere ones, or downsizing the toner. Therefore, functions and performances required for a cleaning device for removing the residual toner are getting more and more difficult to achieve. One of the reasons for this is considered to be that the electrostatic force between the image-bearing member and the toner has been getting stronger. To prevent this problem, it is effective to apply a lubricity imparting agent to the image-bearing member. By applying the lubricity imparting agent to the image-bearing member, a film is formed on the image-bearing member and thus the electrostatic force is reduced, or the friction coefficient of the surface of the image-bearing member is decreased with respect to the toner, and thus the toner is easily removed, thereby improving the cleaning performance. This effect is enhanced as the circularity of the toner is increased, i.e. the toner becomes rounder.

When images of large image area with respect to a cleaning blade that is a toner removal member are inputted, or images of even small image area are continuously inputted in the same area, loads for cleaning become excessive for only the toner removal function of the cleaning blade. To solve this problem, for example, Japanese Patent Application Laid-Open (JP-A) No. 2000-330443 proposes, as a method which is not influenced by the toner amount of the input, to provide a uniformity unit which supplies a lubricant (lubricity imparting agent) after removing the toner by the cleaning blade, and then makes the applied lubricant uniform with respect to the photoconductor.

Meanwhile, for example, JP-A No. 08-234642 discloses a technology for control the applied amount of the lubricant depending on the image area.

However, it is difficult to control applied amount of the lubricant on the image-bearing member using the technology disclosed in JP-A No. 2000-330443, the lubricant is applied at a certain constant amount. In this case, there are problems such that the lubricant is consumed inefficiently, the supplied amount of the lubricant is not sufficient, and the like.

By using the technology disposed in JP-A No. 08-234642, the problem of large loads for cleaning is solved in the case where images of large image area are inputted with respect to the cleaning blade, as mentioned earlier. However, this technique does not solve the problem when images of a small image area are continuously inputted in the same area. Namely, in the case where a toner is continuously inputted in the same area even if a width of an image in a longer direction (an axial direction of the image-bearing member) is short, more amount of the toner is slipped out from the cleaning blade edge as the circularity of the toner is increased. As a result, the friction coefficient on the image-bearing member becomes large, and cleaning failures may occur.

BRIEF SUMMARY OF THE INVENTION

The present invention has been made under the consideration of the aforementioned problems in and situation of the art, and an object of the present invention is to provide an image forming apparatus and a process cartridge, which exhibits excellent cleaning performance in the formation of any sort of images, and does not use excessive amount of a lubricant.

The means for solving the aforementioned problems are as follows:

<1> An image forming apparatus, containing: an image-bearing member; a toner removal unit configured to remove a toner remained on the image-bearing member; a coating unit configured to coat a surface of the image-bearing member with a lubricity imparting agent; a unit configured to change a coated state of the lubricity imparting agent which has been applied to the image-bearing member by the coating unit; and a controlling unit configured to control the coating unit so as to operate a coating mode for at least the period when the image-bearing member is rotated once or more in the course of image formation, wherein the coating mode is a mode in which an amount of the lubricity imparting agent applied onto the image-bearing member is increased compared to an applied amount of the lubricity imparting agent during an ordinal operation for image formation.

The image forming apparatus according to <1> can be expressed in broader terms as follow: The image forming apparatus containing: an image-bearing member; a toner removal unit configured to remove a toner remained on the image-bearing member; a coating unit configured to coat a surface of the image-bearing member with a lubricity imparting agent; and a unit configured to change a coated state of the lubricity imparting agent which has been applied to the image-bearing member by the coating unit, wherein the image forming apparatus is capable of operating a coating mode for at least the period when the image-bearing member is rotated once or more in the course of image formation, and the coating mode is a mode in which an amount of the lubricity imparting agent applied onto the image-bearing member is increased compared to an applied amount of the lubricity imparting agent during an ordinal operation for image formation.

<2> The image forming apparatus according to <1>, wherein the timing for operating the coating mode is set at a time when an accumulative feeding number of a sheet for transfer is reached a certain number.

<3> The image forming apparatus according to <2>, wherein the accumulative feeding number is calculated with the feeding number when the sheet has a length of 216 mm or less in the feeding direction of the sheet, and the doubled feeding number when the sheet has a length of more than 216 mm, a feeding job has the accumulative feeding number of 251 or more as the certain number, and the coating mode is operated once per the feeding number of 250 or less.

<4> The image forming apparatus according to any one of <1> to <3>, wherein the controlling unit is configured to control the coating unit so as to operate the coating mode avoiding at least the time when a latent image is formed on the image-bearing member, the time when a toner image is formed, and the time when the toner image is transferred.

<5> The image forming apparatus according to any one of <1> to <4>, wherein the coating unit is disposed in downstream of the toner removal unit relative to a rotational direction of the image-bearing member, and the coating unit comprises the lubricity imparting agent in a solid state, and a coating member which rotates so as to scrape off the lubricity imparting agent and apply the lubricity imparting agent to the image-bearing member.

<6> The image forming apparatus according to <5>, further containing a coating member driving unit, wherein the controlling unit is configured to control the coating member driving unit so as to drive and rotate the coating member at an increased revolution during the operation of the coating mode.

<7> The image forming apparatus according to <6>, wherein the controlling unit is configured to control the coating member driving unit so as to rotate the coating member at an increased rotation number at least when image formation is started, or when the image formation is ended, or when image formation is started and ended.

<8> A process cartridge, containing: an image-bearing member; a toner removal unit configured to remove a toner remained on the image-bearing member; and a coating unit configured to coat a surface of the image-bearing member with a lubricity imparting agent, wherein the process cartridge is detachably disposed in a body of an image forming apparatus.

<9> An image forming apparatus, containing the process cartridge as defined in <8>.

The present invention provides a novel image forming apparatus and process cartridge which solve the aforementioned problems.

The image forming apparatus as defined in <1> is capable of forming excellent images for a long period without lowering cleaning performance, because of the configuration thereof.

The image forming apparatus as defined in <2> is capable of forming excellent images for a long period without lowering cleaning performance, because of the configuration thereof.

The image forming apparatus as defined in <3> is capable of forming excellent images for a long period without lowering cleaning performance, because of the configuration thereof.

The image forming apparatus as defined in <4> reduces the formation of defective images caused by a rapid change in the charge of the image-bearing member, as the controlling unit is configured to control so that the coating mode is operated at the time other than at least when a latent image is formed on the image-bearing member, when a toner image is formed on the image-bearing member, and when the toner image is transferred.

The image forming apparatus as defined in <5> is capable of efficiently coating the image-bearing member with the lubricity imparting agent in a simple system, because of the configuration of the image forming apparatus.

The image forming apparatus as defined in <6> is capable of efficiently coating the image-bearing member with the lubricity imparting agent in a simple system, as the controlling unit is configured to control the coating member driving unit that drives and rotates the coating member so as to increase the revolution of the coating member during the operation of the coating mode.

The image forming apparatus as defined in <7> is capable of forming excellent images for a long period without lowering cleaning performance, as the controlling unit is configured to control to increase the revolution of the coating member at least when the image formation is started and when the image formation is finished.

The process cartridge as defined in <8> improves the efficiency in the operation for replacement of the process cartridge because of the configuration thereof, as the process cartridge contains at least a image-bearing member, a toner removal unit configured to remove a toner remained on the image-bearing member, and a coating unit configured to coat a surface of the image-bearing member with a lubricity imparting agent.

BRIEF DESCRIPTION OF THE DRAWINGS

FIG. 5 is a block diagram showing the configuration of the control of the first embodiment and the like.

FIG. 6 is a flow chart illustrating the operation of the coating mode of the first embodiment and the like.

DETAILED DESCRIPTION OF THE INVENTION

Hereinafter, embodiments of the present invention (refer to "embodiments" hereinafter) including examples will be explained with reference to the drawings. In each embodiment, the same referential number is applied to the structural element (member or structural part) etc. having the same function and shape and the like, and thus the repetition of the explanation to the same structural element is omitted in the following embodiments, once the structural element is explained in the foregoing embodiment.

First Embodiment

The image forming apparatus of the first embodiment of the present invention, which equipped with the process cartridge will be explained with reference to FIGS. 1 to 6.

Figure 1:
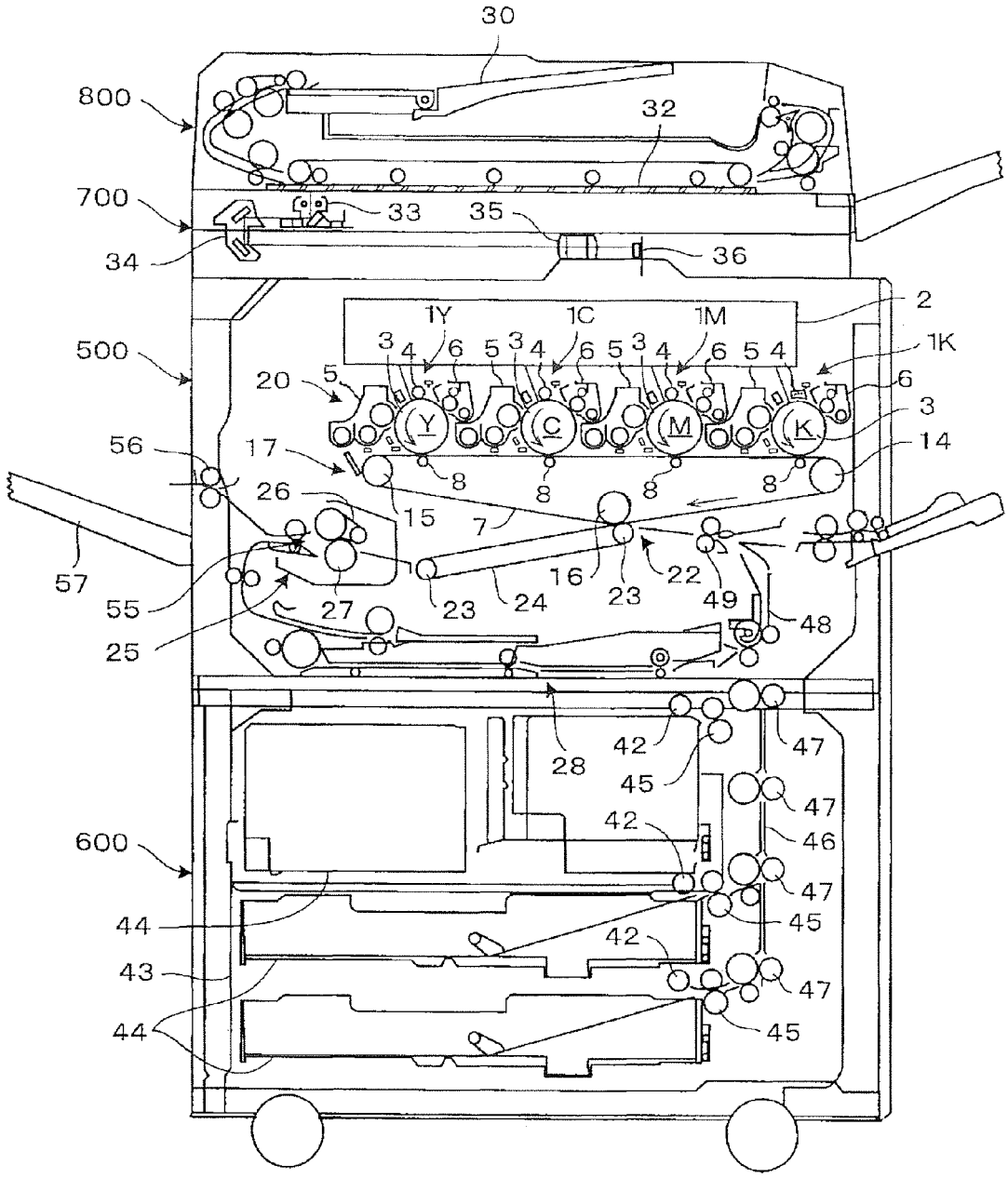
FIG. 1 is a schematic cross-sectional front view showing an image forming apparatus equipped with a process cartridge, which illustrates an example of the first embodiment of the present invention.
Figure 2:
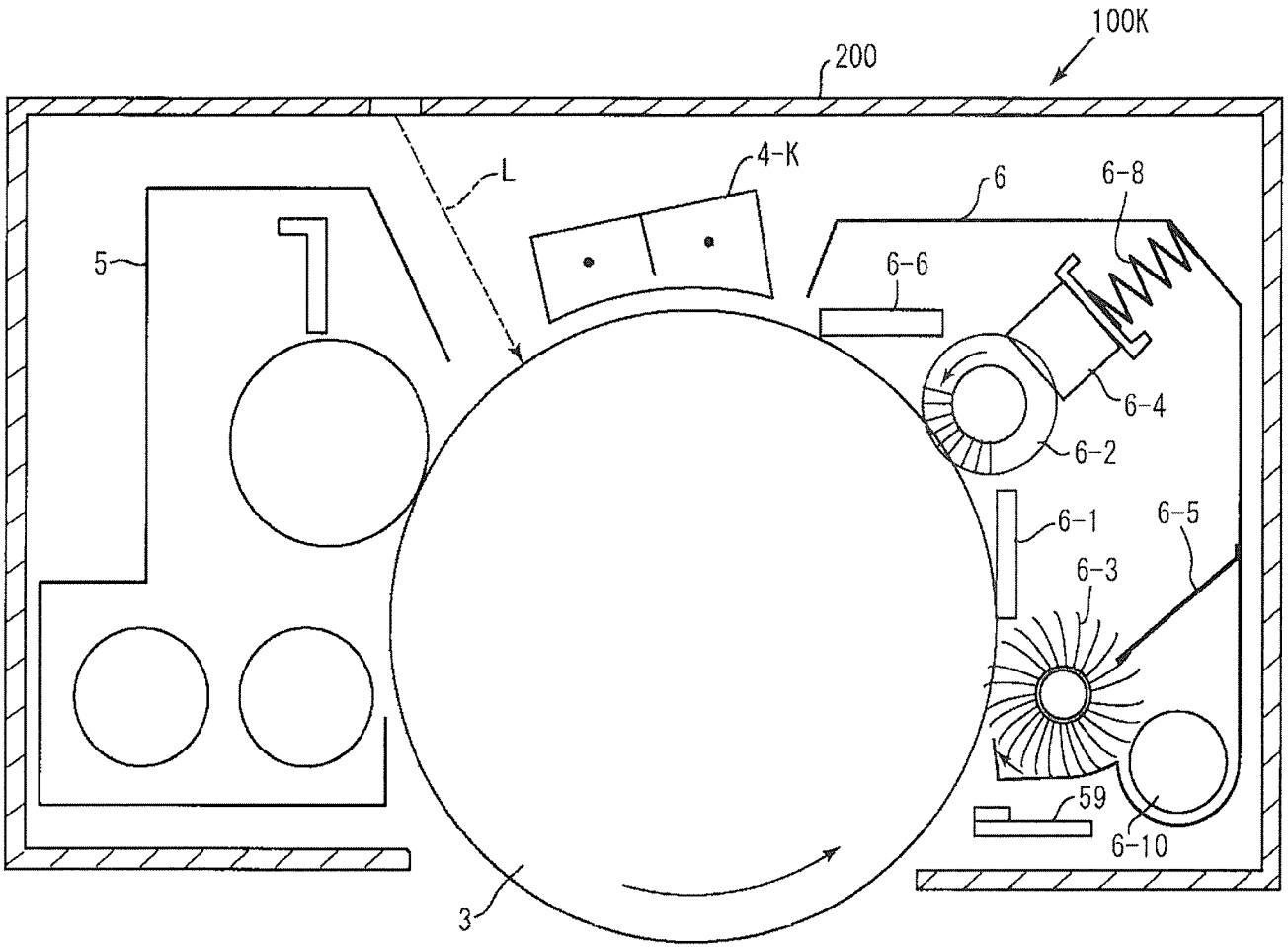
FIG. 2 is a schematic cross-sectional view showing the structure of the process cartridge for black.
Figure 3:
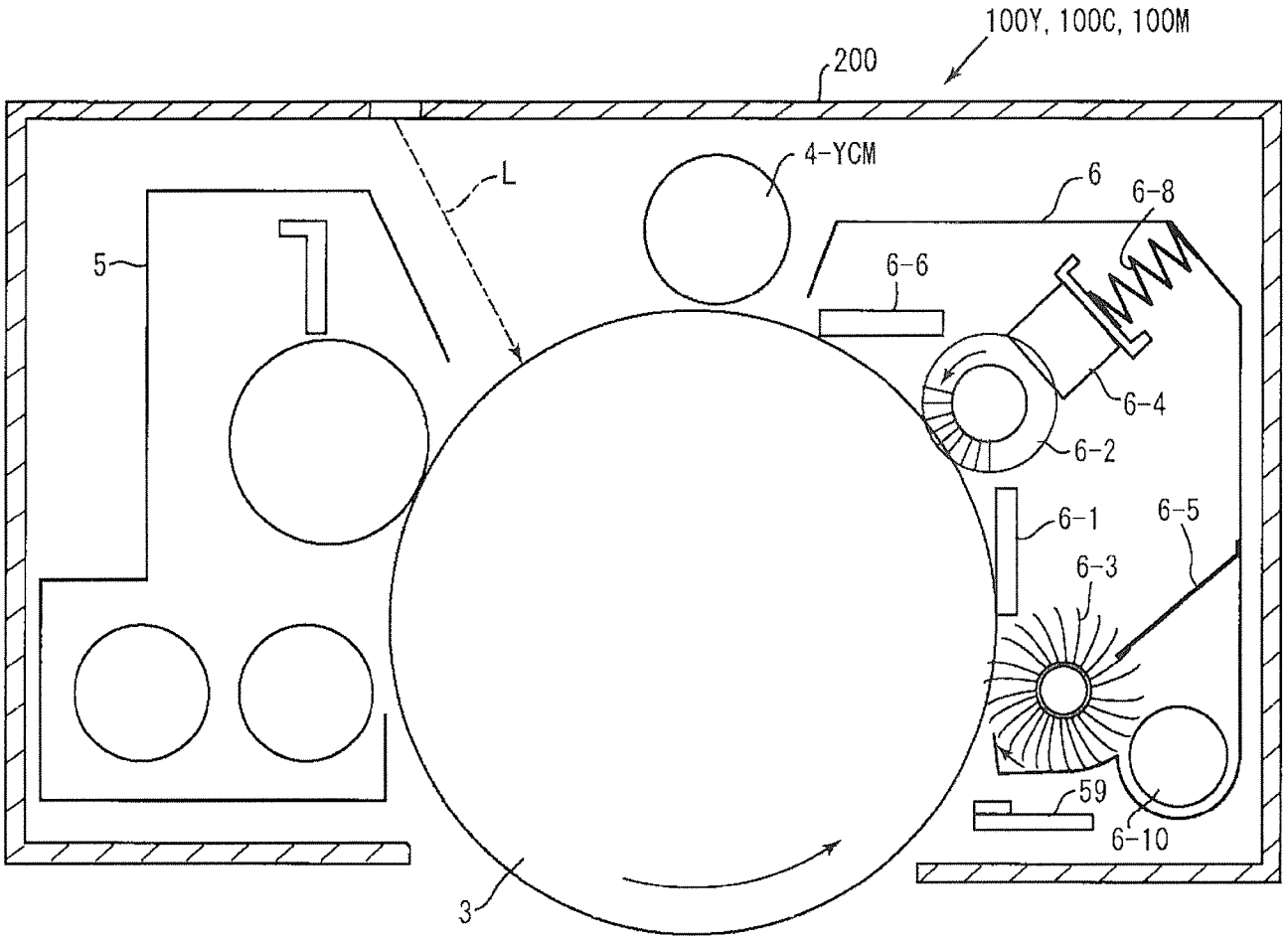
FIG. 3 is a schematic cross-sectional view showing the structure of the process cartridge for yellow, cyan and magenta.

FIG. 1 shows the inner structure of the full color image forming apparatus of the present invention equipped with the process cartridge; FIGS. 2 to 3 show schematic cross-sectional views of the structures of the process cartridges which are detachably disposed in the body of the color image forming apparatus, respectively.

At first, the schematic configurations of the process cartridges which are respectively detachably mounted in the body of the photocopier 500 as a body of a full color image forming apparatus of FIG. 1 will be explained with reference to FIGS. 2 and 3.

The process cartridges, 100Y, 100C, 100M, 100K (hereinafter, may simply referred as "cartridge 100" if clear distinction is unnecessary) respectively corresponding to Y(yellow), C(cyan), M(magenta), K(black) each contain a photoconductor 3, and as each process unit, a charging device 4 as a charging unit, a developing device 5 as a developing unit, and a cleaning device 6 as a cleaning unit in a frame of the process cartridge (hereinafter, may simply referred as "frame") 200, integrally. The process cartridges 10Y, 100C, 100M, 100K are each detachably mounted in the body of the photocopier 500 of FIG. 1 via a detachable installation unit which is not shown in the drawings. An example of the detachable installation unit is a conventional combination of a rail-shaped recess member formed on the body of the photocopier 500, and a rail-shaped projected member formed on the frame 200 of each process cartridge 100 which is detachably inserted into the recess member.

The present embodiment is configured to replace the process cartridges 100Y, 100C, 100M, 100K themselves, but it may be configured such that each of the photoconductor 3, the charging device 4, the developing device 5 and the cleaning device 6 is replaceable from each process cartridges 100Y, 100C, 100M, 100K which is detached from the body of the image forming apparatus.

Moreover, among the process cartridges 100 for four colors of Y(yellow), C(cyan), M(magenta), K(black), the charging devices 4 of Y(yellow), C(cyan), M(magenta) are of a charge roller system which is in non-contact with the photoconductor 3, and the charge roller system is a charging system where AC voltage is interposed to DC voltage to apply the charge. Only the charging device 4 of K(black) uses a charge wire and grid, and of a charging system where only DC voltage is applied. In order to distinguish the types of the charging device in FIGS. 2 and 3, the charging devices are represented as a charging device 4-YCM and charging device 4-K, hereinafter.

Next, the inner structure of the entire full color image forming apparatus, which equipped with each process cartridges 100 will be explained with reference to FIG. 1.

In FIG. 1, 600 denotes a sheet feeding table on which the body of the photocopier 500 is placed, 700 denotes a scanner (an image reading device equipped with a scanning optical system) disposed on the body of the photocopier 500, and 800 denotes an automatic document feeder (ADF) disposed on the scanner 700. Note that, the frame 200 of each process cartridges 100 is not shown in FIG. 1.

Specifically, the image forming apparatus shown in FIG. 1 is an electrophotographic photocopying device of a tandem type indirect transferring system. In almost center of the body of the photocopier 500, an intermediate transferring belt 7 formed of an endless belt that extends in transverse direction is disposed as an intermediate transfer. The example shown in FIG. 1 shows that the intermediate transferring belt 7 is disposed so as to be driven rotatably in the clockwise direction, being suspended around three supporting rollers 14, 15, 16. In this example, an intermediate transferring belt cleaning device 17, which removes any residual toner left on the intermediate transferring belt 7 after transferring an image, is disposed left-hand side of the second supporting roller 15 among these three supporting roller 14, 15, 16. In addition, four image forming units 1Y, 1C, 1M, 1K for Y(yellow), C(cyan), M(magenta), K(black) are lined up in the transverse direction to form a tandem image forming unit 20, and disposed above part of the intermediate transferring belt 7 where is suspended by the first supporting roller 14 and the second supporting roller 15 among the three supporting rollers, along the conveyance direction of the intermediate transferring belt 7.

In the present embodiment, each process cartridge 100Y, 100C, 100M, 100K are provided and mounted to the body of the photocopier 500 to structure the image forming units 1Y, 1C, 1M, 1K, which are image forming stations. Note that, Y, C, M, K, which express the colors, are omitted from the photoconductor 3, the charging device 4, the developing device 5, the cleaning device 6 and the like that form the each image forming unit 1Y, 1C, 1M, 1K, by applying Y, C, M, K only to the referential number 1 of the aforementioned four image forming unit, for the purpose of the simplicity.

Since the image forming units 1Y, 1C, 1M, 1K have the same structure except the charging units and the colors of the toner as mentioned earlier, as representing the image forming units, the image forming unit 1Y will be explained hereinafter. The image forming unit 1Y contains: a drum photoconductor 3 which is rotatable in the direction shown with the arrow in the drawing, as an image-bearing member/latent image-bearing member; and each process units including the charging device 4 (specifically the charging units 4-K, 4-YCM shown in FIGS. 2 and 3) disposed around the photoconductor 3 in the rotational direction, as a charging unit that is one of the process units, the developing device 5 as a developing unit, and the cleaning device 6 as a cleaning unit. In each image forming unit 1Y, 1C, 1M, 1K, the transferring roller 8 is disposed in the position opposite to the photoconductor 3 via the intermediate transferring belt 7.

The exposure unit 2 is disposed above the tandem image forming part 20. The secondary transferring device 22 is disposed opposite to the tandem image forming part 20 via the intermediate transferring belt 7. In the example shown in the drawing, the secondary transferring device 22 is comprised of the secondary transferring belt 24, which is an endless belt, suspended between the two rollers 23, the roller 23 is disposed so as to press against the third roller 16 via the secondary transferring belt 24 and the intermediate transferring belt 7, and the intermediate transferring belt 7 is configured to transfer the image born thereon to a sheet. The fixing device 25 for fixing the transferred image on the sheet is disposed on the side of the secondary transferring device 22. The fixing device 25 has a configuration such that the pressure roller 27 is disposed so as to press against the fixing belt 26 which is an endless belt. The aforementioned secondary transferring device 22 also has a sheet conveyance function to convey the sheet to the fixing device 25 after transferring the image to the sheet. In the example shown in the drawing, the sheet inversion device 28, which is configured to inverse the sheet so as to record the images on the both sides of the sheet, is disposed bellow the secondary transferring device 22 and the fixing device 25, and parallel to the aforementioned tandem image forming part 20.

The operations of the full color electrophotographic device shown in FIG. 1 will be explained next. When a photocopy is taken using this full color electrophotographic device, a document is placed on a document platen 30 of the automatic document feeder 800. Alternatively, the automatic document feeder 800 is opened, a document is placed on a contact glass 32 of the scanner 700, and the automatic document feeder 800 is closed to press the document. When a starting switch (not shown) is pressed, the document placed on the automatic document feeder 800 is transported onto the contact glass 32. When the document is initially placed on the contact glass 32, the scanner 700 is immediately driven to operate a first carriage 33 and a second carriage 34. A light is applied from a light source to the document by the action of the first carriage 33, and the reflected light from the document is directed to the second carriage 34. The reflected light is further reflected by a mirror of the second carriage 34 and transmitted through imaging lens 35 into a read sensor 36 to read the contents of the document by a photoelectric conversion.

When the starting switch (not shown) is pressed, moreover, one of the supporting rollers 14, 15, 16 is rotated by a driving motor (not shown), and the other two supporting rollers are rotated followed by the rotation of the driven supporting roller so that the intermediate transferring belt 7 is driven to rotate. Simultaneously, in the image forming station of each image forming unit 1Y, 1C, 1M, 1K, each photoconductor 3 is evenly charged by each charging device 4 (specifically the charging devices 4-YCM, 4-K shown in FIGS. 2 and 3) and is exposed to a laser light (refer to the laser light L shown in FIGS. 2 and 3) generated with the exposure device 2 by decomposing the colors of the image read by the scanner 700 so as to write the image color by color, and as a result, a latent electrostatic image is formed.

Hereinafter, the image forming station of Y (yellow) will be explained, taking it as an example. The latent electrostatic image forming on the photoconductor 3 is developed with Y (yellow) toner supplied from the developing device 5 corresponding to the latent electrostatic image, and then Y (yellow) toner image is formed. The developer Y (yellow) toner image is transferred onto the intermediate transferring belt 7 by the transferring roller 8 at the section where the photoconductor 3 and the intermediate transferring belt 7 are in contact with each other. In the image forming stations of each image forming unit 1C, 1M, 1K, toner images are formed on the photoconductor 3 sequentially in the order of C (cyan), M (magenta), K (black) in the same manner as above.

Along with the conveyance of the intermediate transferring belt 7, the mono-colored images formed on each photoconductor 3 are sequentially transferred onto the intermediate transferring belt 7, and then a composite color image is formed thereon. In a mean time, when a starting switch (not shown) is pressed, one of feeder rollers 42 of feeder cassettes 44 which are multiply equipped in a paper bank 43 of the feeder table 600 is selectively rotated, sheets (i.e. recording mediums in the form of a sheet, including paper such as a transfer paper, recording paper, etc. and OHP sheets, hereinafter refer to the same) are ejected from the selected feeder cassette 44 and are separated by a separation roller 45 one by one into a feeder path 46 and are transported by a transport roller 47 into a feeder path 48 in the body of the photocopier 500 and are the edge of the sheet is bumped to the nip part of a resist roller 49 which is temporarily stopped and then stopped.

A resist roller 49 is rotated so as to correspond to the timing when the toner image transferred onto the intermediate transferring belt 7 is reached the position for the secondary transfer, namely the timing of the composite color image on the intermediate transferring belt 7, so that the sheet is transport the sheet between the intermediate transferring belt 7 and the secondary transferring device 22 and the color image is recorded on the sheet at once by the secondary transferring device 22. The sheet on which the image is transferred is transported to the fixing device 25 by the secondary transferring device 22, the transferred image is applied with heat and pressure by the fixing device 25 to thereby fix the transferred image on the sheet, and then the sheet changes its direction by action of a switch blade 55 and ejected by an ejection roller 56 to be stacked on an output tray 57 as a one-side copy image. Alternatively, the sheet changes its direction by action of switching blade 55 into the sheet inversion device 28, turns therein, is transported again to the secondary transferring part, followed by image formation on the backside of the sheet. The sheet bearing images on both sides thereof is ejected by the ejecting roller 56 to be stacked on the output tray 57 as a double-sided copy image.

The photoconductor 3 after transferring the developed image to the intermediate transferring belt 7 is cleaned by the cleaning device 6 so as to remove the residual toner, discharged by a discharging lamp (not shown) and then evenly charged again by the charging devices 4-YCM and 4-K. This operation is repetitively carried out.

Moreover, the intermediate transferring belt 7 after transferring the image to the sheet is cleaned with the intermediate transferring belt cleaning device 17 so as to remove the residual toner. Thereafter, the developed image is again transferred onto the intermediate transferring belt 7 from each photoconductor 3, and a composite image is transferred to a sheet. This image formation/imaging operation is repetitively carried out.

With reference to FIGS. 2 and 3, the specific structural operations of the toner removal unit of the cleaning device 6 and the coating unit configured to apply the lubricity imparting agent will be explained, taking the process cartridge 100K of FIG. 2 as an example.

In FIG. 2, the toner removal unit for removing the residual toner on the photoconductor 3 is comprised of a fur brush 6-3 and a cleaning blade 6-1, and the coating unit for applying the lubricity imparting agent to the surface of the photoconductor 3 is comprised of the lubricity imparting agent formed of solidified zinc stearate 6-4, disposed downwards of the toner removal unit relative to the rotational direction of the photoconductor 3, a coating brush 6-2 driven to rotate so as to scrape the zinc stearate 6-4 and apply the same to the photoconductor 3, as a coating member, a coating blade 6-6 configured to evenly and closely apply the zinc stearate 6-4 applied on the photoconductor 3 by the coating brush 6-2.

In FIG. 2, in the order from the upstream to downstream of the rotational direction of the photoconductor 3 shown in the figure, the photoconductor 3 is discharged by a pre-cleaning charging lamp 59, and the residual toner on the photoconductor 3 is brushed about by the fur brush 6-3 so that the residual toner is easily removed by the cleaning blade 6-1. The toner attached onto the fur brush 6-3 is flicked by a flicker 6-5, and the toner scattered away is transported out from the cleaning device 6 by the transporting screw 6-10. The fur brush 6-3 is rotated in the accompanying direction as shown with the arrow in the figures relative to the rotational direction of the photoconductor 3 at where the fur brush 6-3 and the photoconductor 3 are in contact with each other.

The cleaning blade 6-1 is fixed to a holder (not shown) which is rotatably supported in the counter direction to the rotational direction of the photoconductor 3. Moreover, the cleaning blade 6-1 is pressed against the photoconductor 3 by a pressure spring (not shown) so as to remove the toner with the assistance of the applied pressure. The photoconductor 3 from which the toner is removed by the cleaning blade 6-1 is coated with the zinc stearate, which is the lubricity imparting agent (may also refer to a lubricant hereinafter), by the coating brush 6-2.

The application of the zinc stearate is carried out in the following manner. At first, the solidified zinc stearate 6-4 supported in a bracket is pressed with the coating brush 6-2 by the action of a lubricant pressure spring 6-8, and the zinc stearate 6-4 is scraped by the rotation of the coating brush 6-2 in the direction shown with the arrow in the figure, and then applied onto the photoconductor 3. The lubricant pressure spring 6-8 is disposed so as to be stably in contact with the coating brush 6-2 at a force of 2N. Moreover, the coating brush 6-2 is rotated in the counter direction to the rotational direction of the photoconductor 3 at where the coating brush 6-2 and the photoconductor 3 are in contact with each other. By rotating the coating brush 6-2 in the counter direction, the fibers of the coating brush 6-2 by which the zinc stearate 6-4 is scraped are flicked by the photoconductor 3 at downstream side of the contact position with the surface of the photoconductor 3, the powder of the zinc stearate is scattered towards upstream side, relative to the rotational direction of the photoconductor 3, of the contact position between the coating brush 6-2 and the photoconductor 3, attached to the surface of the photoconductor 3, returned to the contact position between the coating brush 6-2 and the photoconductor 3 again, and coated onto the surface of the photoconductor 3 by the coating brush 6-2 once again. Therefore, the layer of the zinc stearate can be thinned as well as improving the coating efficiency.

Figure 5:
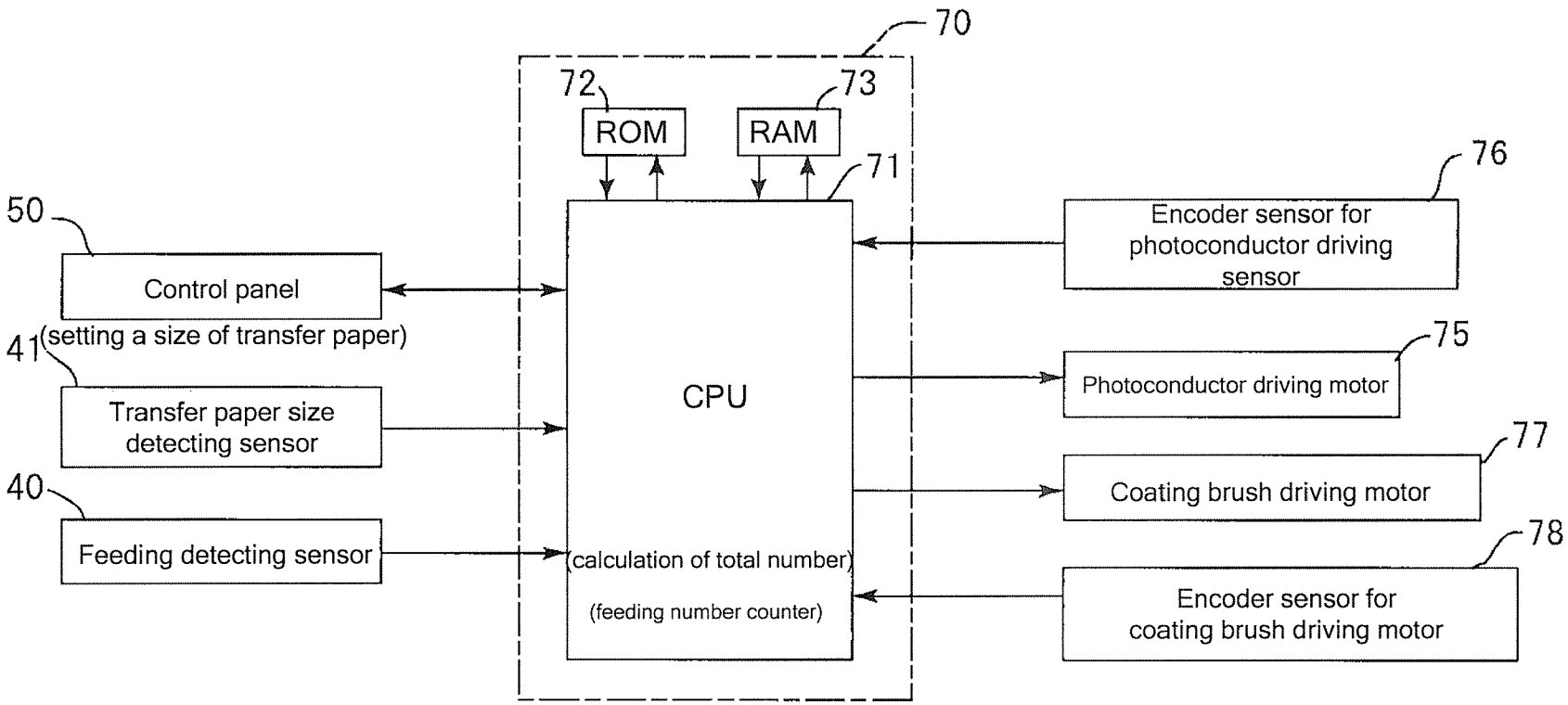

The rotation of the fur brush 6-3 and the coating brush 6-2 is operated such that the rotational driving power of a coating brush driving motor 77 shown in FIG. 5 is applied to the axis of the coating brush 6-2, and rotates the fur brush 6-3 by the connection of the gear. The rotational conditions of each brush 6-3, 6-2 at the ordinal operation is shown in Table 1 below. Thereafter, on the photoconductor 3 which is coated with the zinc stearate 6-4 by the coating brush 6-2, the zinc stearate 6-4 is further closely coated by the coating blade 6-6 supported in the trailing system. The coating blade 6-6 is supported in the trailing system, but may be supported in the counter system. In the manner described above, the transfer residual toner is removed from the photoconductor 3, and the lubricant is applied thereon.

With reference to FIG. 5, the driving mechanism of each of the photoconductor 3, fur brush 6-3, coating brush 6-2 will be supplementary explained. At the time when the process cartridge 100K (the same in the case of the process cartridges 100Y, 100C, 100M) is provided and mounted to the body of the photocopier 500 so that a driven shaft of the photoconductor 3 is connected to the photoconductor driving motor 75 shown in FIG. 5, which is disposed in the photocopier 500, via a driving powder transmitting unit such as a gear, a coupling, and the like (not shown), and a driven shaft of the coating brush 6-2 is connected to the coating brush driving motor 77 shown in FIG. 5, which is disposed in the photocopier 500, via a driving powder transmitting unit such as a gear, a coupling, and the like (not shown). As the coating brush driving motor 77, for example, a stepping motor, the rotational speed of which is easily controlled and of high accuracy, is suitably used. The coating brush driving motor 77 functions as a coating member driving unit for driving to rotate the coating brush 6-2 as the coating member.

An encoder for the photoconductor driving motor is attached to an output shaft of the photoconductor driving motor 75, and an encoder sensor 76 for the photoconductor driving motor shown in FIG. 5 is disposed so as to sandwich the encoder. The rotational speed and rotation number (traveling distance) of the photoconductor 3 are detected by the encoder sensor 76 for the photoconductor driving motor, the positioning of the photoconductor 3 is also detected by the encoder sensor 76 together with a home position sensor (not shown) for detecting the home position of the photoconductor 3.

An encoder for the coating brush driving motor is attached to an output shaft of the coating brush driving motor 77, and an encoder sensor 78 for the coating brush driving motor shown in FIG. 5 is disposed so as to sandwich the encoder. The rotational speeds of the coating brush 6-2 and the fur brush 6-3 are detected by the encoder sensor 78 for the coating brush driving motor. As mentioned earlier, the coating brush 6-2 and the fur brush 6-3 are respectively rotated in the opposite directions to each other with connection by the gear.

Figure 4:
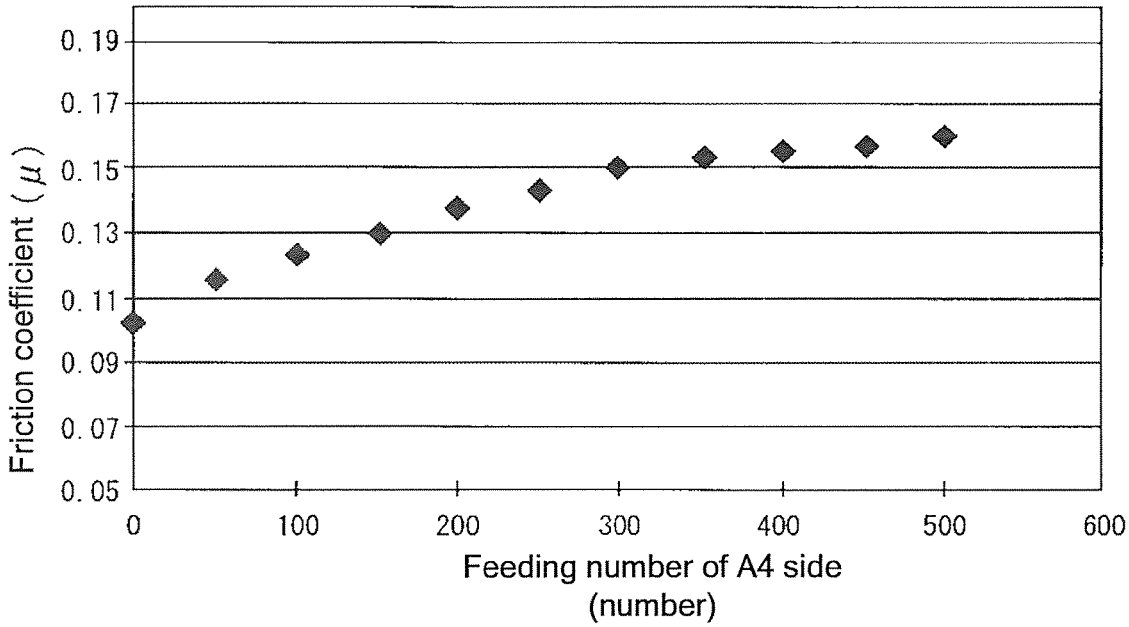
FIG. 4 is a graph showing the transition of friction coefficient of the photoconductor measured in the confirmatory test.

With reference to FIG. 4, the confirmation test related to the timing setting method for operating the coating mode in which the applied amount of zinc stearate as the lubricity imparting agent is increased compared to the amount in the ordinal operation will be explained hereinafter.

In the present embodiment, the timing for operating the coating mode is set at the time when the accumulative feeding number of the transfer paper, as an example of the transfer sheet, is reached a certain number. The reason for this is explained as follow.

FIG. 4 shows the transition of the friction coefficient of the photoconductor with respect to the A4 size transfer paper, when the transfer paper in the size of A4 (side way up) (but letter size) is fed and a solid image is formed on the entire surface of the transfer paper. To maintain the performance in the environment, the friction coefficient of the photoconductor 3 is preferably 0.15 or less. Although it is shown from the figure that less feeding number (accumulative number) leads less friction coefficient, it should be avoided as much as possible to terminate the course of the operation in the middle of the operation in view of practicability for users. Taking this under consideration, the feeding number is preferably about 250 in the feeding of A4 size paper (side way up). By operating the coating mode shown in Table 1 below at the feeding number of 250, the friction coefficient of the photoconductor is maintained at approximately 0.1.

The above-described details are confirmed by the following devices and under the following testing conditions, and the transition of the friction coefficient of the photoconductor is largely changed by changing the coating condition shown in Table 1. Note that, the reason for selecting the conditions such as the ordinal image formation shown in Table 1 is because the charging device 4 itself is stained with zinc stearate and defective images are highly likely formed when the ordinal image formation is set to have the larger coated amount of zinc stearate than that shown in Table 1.

Hereinafter, the devices and testing conditions used for the confirmation test for the transition of the friction coefficient of the photoconductor shown in FIG. 4 and for obtaining the date of the coating mode shown in Table 1 will be listed.

(a) Device used for the test: "imagio MP C7500" manufactured by Ricoh Company Limited
(b) Size of transfer paper: A4 letter size (8.5 inch×11 inch=215.9×279.4 mm)
(c) Type and size of photoconductor: organic photoconductor, diameter of 60 mm
(d) Material of cleaning blade 6-1: polyurethane rubber
(e) Material of fur brush 6-3: conductive polyester brush
(f) Material of flicker 6-5: leaf spring
(g) Material of coating brush 6-2: conductive polyester brush
(h) Environment: temperature of 23° C., humidity of 50RH %

With reference to FIG. 5, the control mechanism of the present embodiment will be explained. The control panel 50 shown in FIG. 5 is disposed at the vicinity of the scanner 700 shown in FIG. 1. On the control panel 50, various switches, various keys, a touch panel, a display device and the like for operating the full color image forming apparatus (photocopier) shown in FIG. 1 are arranged. Moreover, the control panel 50 is provided with an element functioning as a sheet size setting unit which identifies a size of a sheet. As the sheet size setting unit, a conventional example which set a size of a transfer paper in a touch panel system may be used.

Other than the sheet size setting unit mentioned above, the sheet size recognition unit including a conventional sheet size detecting unit which automatically detect and identify a size of a sheet may be used. One example of the sheet size detecting unit is the transfer paper size detecting sensor 41 shown in FIG. 5, this includes the one comprised of the group of known sensors for automatically detecting a width size (side size) of a transfer paper in connection with the positioning of a pair of side fences, which are disposed in the feeding tray, in the sheet width direction, and the one comprised of the group of known sensors, a plurality of which are disposed in the feeding tray along the feeding direction, and which automatically detect a size (longitudinal direction) of a transfer paper in the feeding direction.

The feeding detecting sensor 40 is disposed, for example, at an outlet of the nip of the resist rollers 49 shown in FIG. 1, and comprised of a reflective photosensor for counting the feeding number of the transfer paper transported by the resist rollers 49.

In FIG. 5, the referential number 70 denotes a control device. The control device 70 is equipped with the known microcomputer provided with CPU 71, ROM 72, RAM 73, a timer, and the like. CPU 71 controls the operations of the liquid crystal display device provided on the control panel 50, the photoconductor driving motor 75, the coating brush driving motor 77, and each of the aforementioned devices and parts (not shown in FIG. 5) based on various signals transmitted from each key or switch provided on the control panel 50, the sheet size setting unit, the feeding detecting sensor 40, the transfer paper size detecting sensor 41, and each encoder sensor 76, 78. In addition, CPU 71 has a control function for carrying out the operation program shown in FIG. 6, and the computing function for counting the feeding number of the transfer paper and calculating the total feeding number, which is an accumulative feeding number.

Figure 6:
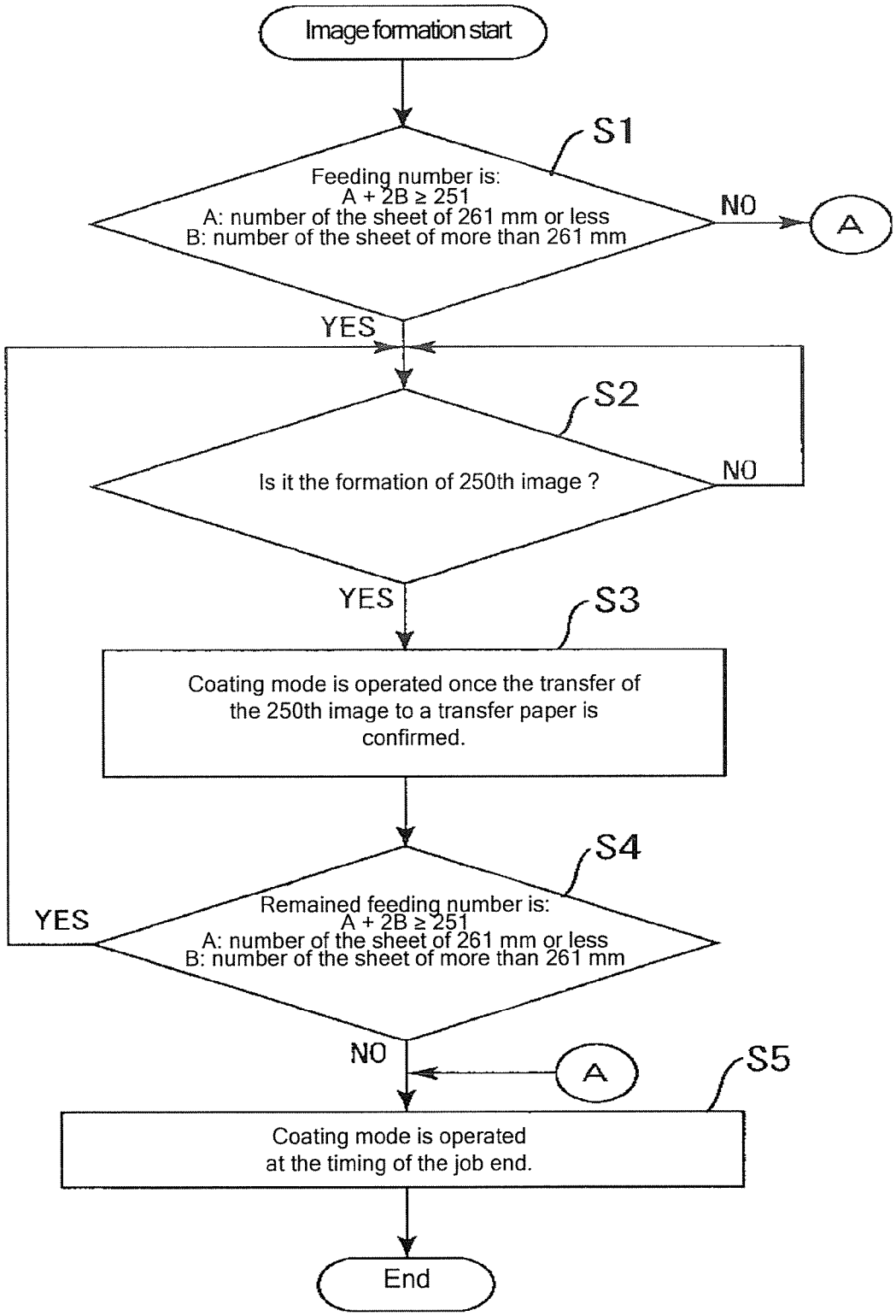

The operation program shown in FIG. 6 for exhibiting the function of CPU 71 or related data is previously recorded in ROM 72. RAM 73 has a function to record various data transmitted from CPU 71 at anytime, but it is preferable to store backups so as to record the continuous feeding number of the transfer paper as the accumulative feeding number.

With reference to FIG. 6, the way of the control to change the coating condition of the lubricant in the middle of the image formation will be explained. The operation flow shown in FIG. 6 is carried out under the control and monitoring by CPU 71 of the control device 70.

As mentioned earlier, the image formation is initiated by the instruction (pressing the starting switch not shown in the figure) for starting the image formation. At first, the information for the image size (a size of the transfer paper) and the feeding number of the transfer paper is obtained (Step S1). The numbers of the images having the image size (transfer paper size) whose length in the vertical scanning direction (sheet feeding/feeding direction and the length of the photoconductor 3 in the rotational direction) is 216 mm or less, and whose length in the same direction is more than 216 mm are confirmed, the number for 216 mm or less is counted as it is, and the number for 216 mm is doubled to count, and the total number is calculated. Thereafter, when the calculated number is, for example, less than 251, the coating mode shown in Table 1 in which the applied amount of the lubricant is more than the amount at the ordinal image formation is operated at the time of the job end (Skip to Step 5, if the answer is No at Step S1).

On the other hand, when the calculated number is, for example, more than 251, the image formation on the photoconductor 3 is terminated after the image is transferred to the two hundred fiftieth transfer paper (Step S2), and the coating mode is operated (Step S3). After operating the coating mode, the remained feeding number is confirmed (Step 4), and the coating more is operated at the time of job end if the feeding number is less than 251 (Step S5). If it is more than 251, the image formation on the photoconductor 3 is terminated after the image is transferred to the two hundred fiftieth transfer paper, and the coating mode is operated. The coating mode is repetitively operated in this manner.

The coating mode is explained next. In the coating mode, as shown in Table 1, the applied amount of zinc stearate is increased by changing the rotational speed (rotation number) of the coating brush driving motor 77 for the coating brush 6-2, and the coating mode is operated at least for the period when the photoconductor 3 is rotated once or more. Table 1 shows a relationship between the rotational speed of the photoconductor 3, the rotational speed of the fur brush 6-3 and the coating brush 6-2, and the applied amount of zinc stearate (lubricity imparting agent).

TABLE 1

| Coating condition | Rotational speed of fur brush (mm/sec) | Rotational speed of coating brush (mm/sec) | Coated amount of zinc stearate (mg/Km) |
|---|---|---|---|
| Ordinal image formation | 360 | 200 | 110 |
| Coating mode | 540 | 300 | 165 |

Note that, (mg/Km) shown in Table 1 expresses the coated amount of zinc stearate with respect to the traveling distance of the photoconductor.

As has been explained above, according to the present embodiment, the problems in the art can be solved, excellent images can be formed for a long period without lowering cleaning performance, the formation of defective images caused by a rapid change in the charge of the image-bearing member can be reduced, and the efficiency in the operation for replacement of the process cartridge is improved.

Second Embodiment

The second embodiment of the image forming apparatus of the present invention is the same as the first embodiment shown in FIGS. 1 to 6, provided that it is a full color image forming apparatus equipped with four image forming units 1Y, 1C, 1M, 1K as shown in FIG. 1 where the frame 200 is not shown and the process cartridges 100Y, 100C, 100M, 100K are removed. Namely, the second embodiment is the full color image forming apparatus in which the structural components of the process cartridges 100Y, 100C, 100M, 100K are disposed at the vicinity of the body of the photocopier 500, without the frame 200 (Claims 1-7).

For this reason, according to the second embodiment, the same effects obtained by the first embodiment, other than the effect obtained by the image forming apparatus containing the process cartridges 100Y, 100C, 100M, 100K, can be exhibited.

As has been explained above, the present invention is applied to any image forming apparatus or the like, as long as the image forming apparatus contains the image-bearing member, the toner removal unit configured to remove the residual toner remained on the image-bearing member, the coating unit configured to coat the surface of the image-bearing member with the lubricity imparting agent, and unit configured to change a coated state of the lubricity imparting agent which has been applied to the image-bearing member by the coating unit, or the image forming apparatus is an image forming apparatus to which a process cartridge is detachably mounted. In other words, the present invention is applied to any image forming apparatus or the like, as long as the image forming apparatus has conventional configurations, namely the aforementioned image-bearing member, toner removal unit, coating unit, and unit configured to change a coated state of the lubricity imparting agent.

The present invention has been explained in the specific embodiments and the like, but the technological scope disclosed by the present invention is not limited to the exemplified embodiments or examples mentioned above, and they may be arbitrarily combined together. It is obvious for ordinary skilled in the art that various embodiments, modifications or examples can be obtained depending on the necessity or use within the scope of the present invention.

What is claimed is:

1. An image forming apparatus, comprising:

an image-bearing member;

a toner removal unit configured to remove a toner remained on the image-bearing member;

a coating unit configured to coat a surface of the image-bearing member with a lubricity imparting agent;

a unit configured to change a coated state of the lubricity imparting agent which has been applied to the image-bearing member by the coating unit; and a controlling unit configured to control the coating unit so as to operate a coating mode for at least the period when the image-bearing member is rotated once or more in the course of image formation, wherein the coating mode is a mode in which an amount of the lubricity imparting agent applied onto the image-bearing member is increased compared to an applied amount of the lubricity imparting agent during an ordinal operation for image formation, the timing for operating the coating mode is set at a time when an accumulative feeding number of a sheet for transfer is reached a certain number, and the accumulative feeding number is calculated with a feeding number when the sheet has a length of 216 mm or less in the feeding direction of the sheet, and a doubled feeding number when the sheet has a length of more than 216 mm, a feeding job has the accumulative feeding number of 251 or more as the certain number, and the coating mode is operated once per the feeding number of 250 or less.

2. The image forming apparatus according to claim 1, wherein the controlling unit is configured to control the coating unit so as to operate the coating mode avoiding at least the time when a latent image is formed on the image-bearing member, the time when a toner image is formed, and the time when the toner image is transferred.

3. The image forming apparatus according to claim 1, wherein the coating unit is disposed downstream of the toner removal unit relative to a rotational direction of the image-bearing member, and the coating unit comprises the lubricity imparting agent in a solid state, and a coating member which rotates so as to scrape off the lubricity imparting agent and apply the lubricity imparting agent to the image-bearing member.

4. The image forming apparatus according to claim 3, further comprising a coating member driving unit, wherein the controlling unit is configured to control the coating member driving unit so as to drive and rotate the coating member at an increased revolution during the operation of the coating mode.

5. The image forming apparatus according to claim 4, wherein the controlling unit is configured to control the coating member driving unit so as to rotate the coating member at an increased rotation number when image formation is started, or when the image formation is ended, or when image formation is started and ended.

* * * * *